US005361521A

United States Patent [19]

Burtch

[11] Patent Number: 5,361,521

[45] Date of Patent: Nov. 8, 1994

[54] DISPLAY FRAME FOR BASEBALL CARDS AND THE LIKE, METHOD OF MAKING, AND BLANK THEREFOR

[75] Inventor: Ronald P. Burtch, West Hill, Canada

[73] Assignee: Ronald P. Burtch & Associates Limited, Scarborough, Canada

[21] Appl. No.: 8,977

[22] Filed: Jan. 26, 1993

[51] Int. Cl.[5] ..... G09F 1/12

[52] U.S. Cl. ..... 40/152.1; 40/155; 40/159

[58] Field of Search ..... 40/154, 155, 159, 537, 40/124.1, 152.1, , 490; 248/459, 464

[56] References Cited

U.S. PATENT DOCUMENTS 2,074,420 3/1937 Otis .
2,453,902 11/1948 Graham ..... 40/124.1
2,889,646 6/1959 Matthias et al. .
3,545,115 12/1970 Nichols ..... 40/124.1 X
4,001,958 1/1977 Fecko ..... 40/124.1
4,161,833 7/1979 Wagner .
4,309,835 1/1982 Naeve .
4,366,636 1/1983 Hearsh .
4,450,638 5/1984 Bader ..... 40/124.1 X
4,622,769 11/1986 Friedman .
4,780,975 11/1988 Friedman ..... 40/155
4,944,968 3/1990 Wagner .

*Primary Examiner*—Brian K. Green
*Attorney, Agent, or Firm*—Larson & Taylor

[57] ABSTRACT

A display frame is provided for displaying a baseball card or the like. The display frame includes a planar front section including framing portions defining a display or viewing opening for the card. A planar rear section is folded over from one edge of the front section and includes an erectable support assembly erectable from the plane of the rear section for supporting the display frame so as to enable the display frame to stand up on a support surface. A pocket forming intermediate section is open at the top and includes spaced side portions one of which is folded over from the opposite edge of the front section. The intermediate section is disposed between the front and rear sections so as to form a pocket behind the display opening in which a card can be received for display. A method for making the display frame and a blank used in making the display frame are also provided.

14 Claims, 1 Drawing Sheet

DISPLAY FRAME FOR BASEBALL CARDS AND THE LIKE, METHOD OF MAKING, AND BLANK THEREFOR

FIELD OF THE INVENTION

The invention relates to an inexpensive, easy to assembly display frame for baseball cards or the like.

BACKGROUND OF THE INVENTION

There has been a continuous, increasing interest in baseball cards particularly among the young, and considerable attention has been attracted by the large amounts of money which have been and are being spent on rare cards by collectors both young and old. More generally, financial considerations aside, young baseball fans in particular are often keenly interested in collecting cards depicting their favorite players or favorite teams. Of course, there are many other types of cards that are collected including those associated with other sports such as football and basketball.

As mentioned above and is discussed below, the present invention is concerned with providing an inexpensive, easy to assembly display frame device which enables a young fan to display his or her favorite card on a table, mantlepiece or the like. There are, of course, various forms of inexpensive frames or card holders which enable cards or pictures to be displayed and some of these are folded out from and otherwise produced from a cardboard blank or the like. Patents which disclose such frames or holders include the following: U.S. Pat. No. 2,074,420 (Otis); U.S. Pat. No. 2,889,646 (Matthias et al); U.S. Pat. No. 4,161,833 (Wagner); U.S. Pat. No. 4,309,835 (Naeve); U.S. Pat. No. 4,366,636 (Hearsh); and U.S. Pat. No. 4,622,769 (Friedman) .

SUMMARY OF THE INVENTION

In accordance with the invention, a display frame or frame device is provided which is particularly adapted for use in displaying baseball cards or other cards depicting other sports figures or the like but which is not limited to such applications. The display frame of the invention is simple and inexpensive to manufacture, making it useful in connection with promotions or giveaways wherein the display frame would, for example, be given away with the purchase of another item. The display frame of the invention is easy to use and enables a user of the display frame to, for example, display a favorite baseball card (or the like) in an effective and pleasing manner. The invention also concerns or a method for making the display frame and a blank used in making the display frame.

According to one aspect of the invention, a display frame is provided for displaying a card or the like, the display frame comprising: a planar front section including top, bottom and side framing portions defining a display opening for such a card; a planar rear section folded over from one edge of said front section and including erectable support means erectable from the plane of the rear section for supporting the display frame so as to enable the display frame to stand up on a support surface; and an intermediate section open at the top and including first and second spaced, interconnected side portions one of which is folded over from the opposite edge of the front section, the intermediate section being disposed between said front and rear sections so as to form a pocket behind the display opening and between the front and rear sections in which a card can be received for display.

Advantageously, a notch formed in the upper edge of the rear section is provided for facilitating removal of a card received in said pocket.

The support means preferably comprises a support element pivotable along a fold line from an initial position wherein the support element lies in the plane of the rear section to a support position wherein the support element extends outwardly from the rear section substantially perpendicular to the plane of the rear section. The support means preferably further comprises a bracing element pivotable along a further fold line to a bracing position wherein the bracing element retains the support element in the support position thereof. The support element advantageously comprises a substantially triangular planar support member. The bracing element advantageously comprises a planar tab member which, in the bracing position thereto, extends orthogonal to the plane of the planar support member. Preferably, the tab member includes a slit therein in which the triangular support member is received in the bracing position of said tab member.

In accordance with a further aspect of the invention, a blank is provided for producing a display frame for displaying a card or the like, the blank comprising: a central section, and first and second side sections defined by fold lines on opposite sides of the central section. The central section includes a removable central panel which, when removed, creates a central opening therein. The first side section includes a removable central panel which, when removed, creates a central opening that, in use, with the first side section folded over behind the central section in the assembled display frame, registers with the central opening in the central section and creates a card receiving pocket behind the central opening in the central section. The second side section includes an erectable support means for, when erected, enabling the assembled display frame to stand up on support surface.

Preferably, the blank includes a notch formed in the upper edge of the second side section for, in use, facilitating removal of a card received in the card receiving pocket.

In common with the display frame described above, the support means formed in the second side section of the blank preferably comprises a support element pivotable, in use, along a fold line from an initial position wherein the element lies in the plane of the second side section to a support position wherein the element extends outwardly from the second side section substantially perpendicular to the plane of the second side section. Similarly, the support means preferably further comprises a bracing element pivotable, in use, along a further fold line in the second side section of the blank to a bracing position wherein the bracing element retains the support element in the support position thereof. The support element advantageously comprises a substantially triangular planar support member, while the bracing element advantageously comprises a planar tab member which, in use in the bracing position thereof, extends orthogonal to the plane of the planar support member. The tab member advantageously includes a slit therein in which the triangular support member is received in the bracing position of the tab member.

According to yet another aspect of the invention, a method is provided for producing a display frame displaying a card or the like, the method comprising the steps of: providing fold lines in a blank to produce a central section and first and second lateral sections on opposite sides of the central section; selectively cutting the first lateral section to produce erectable means therein for, when erected, enabling the assembled display frame to stand up on a support surface in use; selectively cutting the second lateral section to produce a central removable panel therein; folding said first and second lateral sections along said fold lines so that the second section is disposed directly behind the central section and said first section is disposed behind the second section; affixing the first, central, and second sections together to produce a framing unit; and removing the central removable panel of the second lateral section to thereby from a pocket therein between the central section and the first section in which a card can be received.

The removing step preferably comprises cutting at least along the top of the framing unit so as to effect removal of the central panel of the second lateral section. In a preferred embodiment, the framing unit is also cut along the bottom thereof.

Preferably, the method further comprises forming a notch in the upper edge of said first lateral section, which is used, as explained above, in facilitating removal of card from the finished display frame.

Advantageously, a discontinuous fold is formed in the first lateral section which extends parallel to the longitudinal axis of the first lateral section, and the selective cutting of the first lateral section comprises cutting out a support element adjacent to said fold line such that the fold line forms an edge of said support element. Preferably, the discontinuous fold line includes spaced colinear parts, an orthogonal fold line is formed in said first lateral section between the spaced parts, and the selective cutting of the first lateral section comprises cutting out a bracing element adjacent the orthogonal fold line such that the orthogonal fold line forms an edge of the bracing element.

Other features and advantages of the invention will be set forth in, or apparent from, the following detailed description of preferred embodiments of the invention.

DESCRIPTION OF THE PREFERRED EMBODIMENTS

Figure 1:
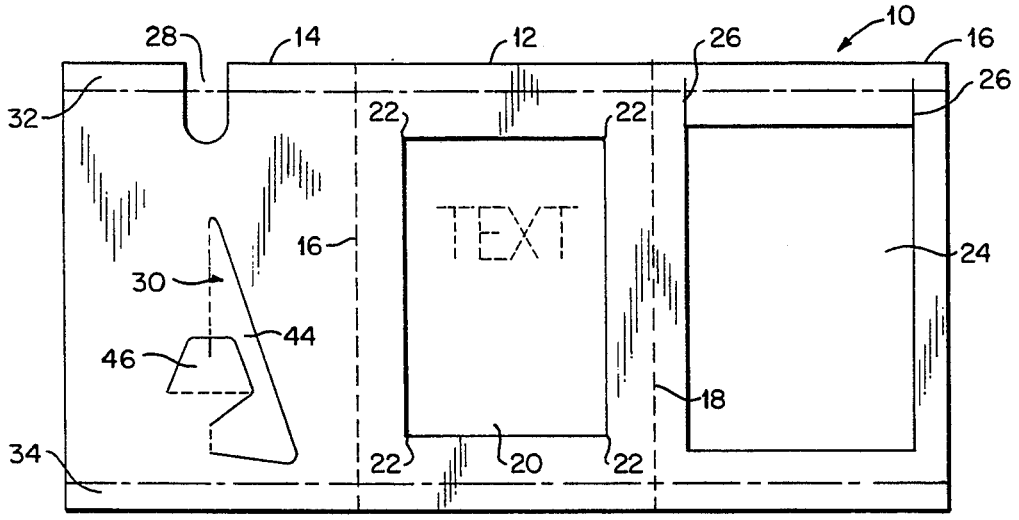
FIG. 1 is a plan view of a blank used in making the display frame of the invention.

Referring to FIG. 1, a die cut flat or blank 10 is shown which is used in constructing the card display device of the invention. The blank 10 includes a center section 12 and integral left hand and right hand side sections 14 and 16 which are separated from the center section 12 by fold lines 16 and 18.

The center section 12 includes a central removable panel 20 which is almost completely cut out from blank 10, i.e., cut out so that only very small connecting areas, indicated schematically at 22, remain which connect panel 20 to the remainder of the blank 10. Panel 20 is thus adapted to be easily removed by a purchaser or user of the device. Panel 20 may be provided with the written material (as indicated, by the notation TEXT), e.g., material describing the device, and including the trade or descriptive name of the device, as well as a suitable illustration (e.g., a baseball action figure or figures). The adjacent framing position of the center section 12 may also include text material (as is also indicated by the notation TEXT) and this could include, e.g., a team logo and/or a team name.

The right hand (as viewed in FIG. 1) side section 16 also includes a central removable panel 24 which is substantially the same size as panel 20 and is similarly almost completely cut out from blank 10. Extended cut lines, indicated at 26, are provided at the sides of panel 24 which extend up towards the upper edge of the blank 10, as shown.

The left hand side section 14 includes an elongate notch 28 having a rounded lower edge, and a fold-out support assembly 30 which is partially cut out therein and which is described in more detail below in connection with FIGS. 4 and 5.

Figure 2:
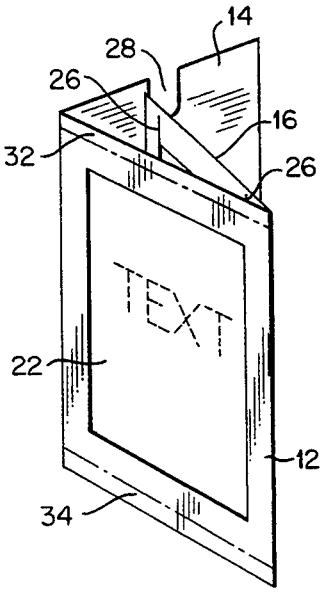
FIG. 2 is a perspective view of the partially assembled display frame.

After blank 10 has been cut out as so to take the form shown in FIG. 1, the sections are folded together as shown in FIG. 2, with central section 12 in front, side section 16 folded next behind, and side section 14 folded at the back. The sections 12, 14 and 16 are then joined together, e.g., by a glue or other adhesive, preferably applied to contacting portions of the sections.

Figure 6:
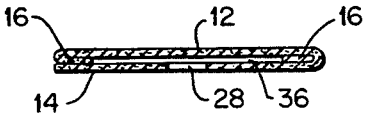
FIG. 6 is a cross sectional view taken generally along line VI—VI of FIG. 4.

Next, relatively thin strips 32 and 34 are removed from the upper and lower edges of the assembled unit by cuts along these respective edge indicated by chain lines in FIGS. 1 and 2. The upper cut 32 will, as is evident from FIG. 1, reduce the depth of notch 28 and intersect cut lines 26 so that with panel 24 can be removed and thus making section 16 open at the top. As indicated in FIG. 6, this creates a chamber or pocket 36 between the central (front) section 12 and the side (rear) section 14, with sides of the chamber 36 being formed by the remaining framing sections of side (intermediate) section 16.

Figure 3:
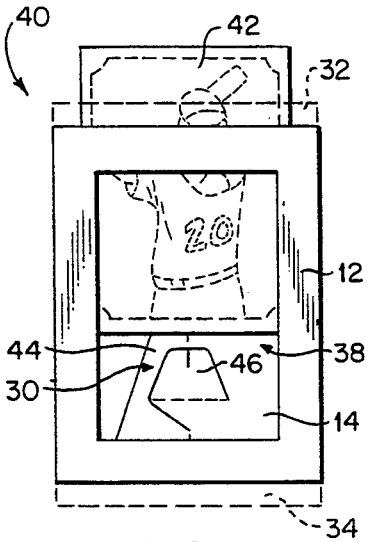
FIG. 3 is a front elevational view of the fully assembled display frame.

Referring to FIG. 3, a front view of the completed device, generally denoted 40, is shown, with panel 20 removed to form a viewing opening 38. Further, a conventional baseball card 42 is shown being inserted into pocket 36 through the upper opening created by the removal of panel 24. It will, of course, be appreciated with card 42 fully inserted into pocket 36 the card will be framed by the remaining, framing portions of front section 12 and will be viewable through opening 38. Notch 28 facilitates removal of a card corresponding to card 42 after it is inserted into pocket 38 of framing device 40.

Figure 4:
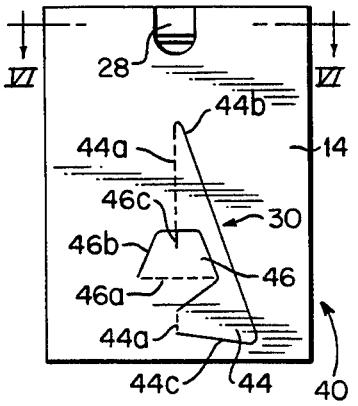
FIG. 4 is a rear elevational view of the fully assembled display frame of FIG. 3.
Figure 5:
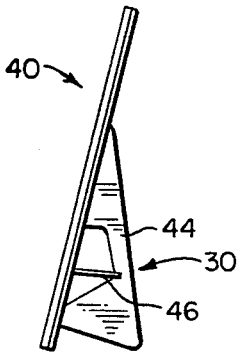
FIG. 5 is a side elevational view of the display frame with the erectable support assembly erected.

Referring to FIGS. 4 and 5, the fold-out support or stand assembly 30 of FIGS. 1 and 3 is shown in more detail. The assembly 30 includes a generally triangular support portion 44 formed by a generally straight, discontinuous fold line **44*a*, which extends vertically in FIG. 4, a relatively long slanted edge 44*b* cut out from rear section 14 and disposed at a small, acute angle to fold line 44*a* and a shorter slanted edge 44*c* also cut out from rear section 14 and forming angle of close to 90° to fold line 44*a*. The assembly 30 further includes a bracing tab or strut portion 46 of generally trapezoidal shape including a fold line 46*a* at the bottom thereof, and an upper portion 46b cut out from rear section 14 and including a central slit 46c** in the upper edge thereof extending perpendicular to this edge.

In use, triangular support position 44 is pivoted around fold line 44a out of the plane of rear section 14 to a position generally perpendicular to that plane and thus to that of framing device 40, as shown in FIG. 5, and strut or brace portion 46 is pivoted downwardly around fold line 46a to a position wherein portion 46 extends generally perpendicular to the plane of framing device 40 and slot 46c receives a central part of support portion 44. Thus, a braced support for device 40 is provided which permits the device to stand up on flat surface such as that of a nightstand, table, mantlepiece or the like, to permit display of a card 42 received in device 40.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A display frame for displaying a card, said display frame comprising:

a planar front section including top, bottom and side framing portions defining a display opening for a card;

a planar rear section defining a plane and being folded over from one edge of said front section having a first fold line, said planar rear section including erectable support means erectable from the plane of the rear section for supporting the display frame so as to enable the display frame to stand up on a support surface; and an intermediate section having a top and a top edge and having a bottom and including first and second spaced, interconnected side portions which are interconnected by a bottom interconnecting portion at the bottom of said intermediate section and are spaced apart at the top of said intermediate section so that said intermediate section has an opening at the top edge thereof between said side portions, one of said side portions being folded over from the opposite edge of said front section having a second fold line, said intermediate section being disposed between said front and rear sections so as to form a pocket behind said display opening and between said front and rear sections in which a card can be received for display, said pocket being defined by said side portions, said interconnecting bottom portion of said intermediate section and said front and rear sections, and having a top opening formed by said opening at the top edge of said intermediate section.

2. A display frame as claimed in claim 1 wherein said rear section includes an upper edge, said display frame further comprising a notch formed in the upper edge of said rear section for facilitating removal of a card received in said pocket.

3. A display frame as claimed in claim 1 wherein said support means comprises a support element pivotable along a fold line from an initial position wherein said element lies in the plane of the rear section to a support position wherein said element extends outwardly from the rear section substantially perpendicular to the plane of the rear section.

4. A display frame as claimed in claim 3 wherein said support means further comprises a bracing element pivotable along a further fold line to a bracing position wherein said bracing element retains said support element in said support position.

5. A display frame as claimed in claim 4 wherein said support element comprises a substantially triangular planar support member.

6. A display frame as claimed in claim 5 wherein said bracing element comprises a planar tab member which, in said bracing position, extends orthogonal to the plane of said planar support member.

7. A display frame as claimed in claim 6 wherein said tab member includes a slit therein in which said triangular support member is received in the bracing position of said tab member.

8. A blank for producing a display frame for displaying a card, said blank comprising:

a central section and first and second side sections defined by fold lines on opposite sides of said central section;

said central section including a removable central panel which, when removed, creates a central opening in said central section, said removable panel having an outer peripheral edge defined by partially cut slits for facilitating removal of said panel, said first side section having a top, bottom and side edges and including a removable central panel having an outer periphery which is defined by partially cut slits in said first side section, said slits of said first side section being spaced from the bottom and side edges of said first side section and extending to the top edge of said first side section so that said central panel, when removed, creates a central opening in said first side section that is open at the top edge of said first side section and that, in use with said first side section folded over behind said central section in the assembled display frame, registers with the central opening in said central section and creates a card receiving pocket behind said central opening in said central section; and said second side section including erectable support means for, when erected, enabling the display support, when assembled from the blank, to stand up on a support surface.

9. A blank as claimed in claim 8 wherein said second side section includes a top edge and said blank further comprising a notch formed in the top edge of said second side section for facilitating removal of a card received in said card receiving pocket.

10. A blank as claimed in claim 8, wherein said second side section defines a plane and wherein said support means comprises a support element pivotable along a fold line from an initial position wherein said element lies in the plane of the second side section to a support position wherein said element extends outwardly from the second side section substantially perpendicular to the plane of the second side section.

11. A blank as claimed in claim 10 wherein said support means further comprises a bracing element pivotable along a further fold line in said second side section to a bracing position wherein said bracing element retains said support element in said support position.

12. A blank as claimed in claim 11 wherein said support element comprises a substantially triangular planar support member.

13. A blank as claimed in claim 12 wherein said support member defines a plane and wherein said bracing element comprises a planar tab member which, in said bracing position, extends orthogonal to the plane of said planar support member.

14. A blank as claimed in claim 13 wherein said tab member includes a slit therein in which said triangular support member is received in the bracing position of said tab member.

* * * * *